United States Patent [19]

Weidman

[11] Patent Number: 4,792,054

[45] Date of Patent: Dec. 20, 1988

[54] TAMPER-EVIDENT CLOSURE FOR DISPENSERS

[75] Inventor: Craig C. Weidman, Wooster, Ohio

[73] Assignee: Weatherchem Corporation, Twinsburg, Ohio

[21] Appl. No.: 84,877

[22] Filed: Aug. 13, 1987

[51] Int. Cl.[4] ..... B65D 51/18

[52] U.S. Cl. ..... 222/23; 220/253; 220/258; 220/266; 222/153; 222/480; 222/541; 222/548

[58] Field of Search ..... 222/23, 41, 153, 480, 222/516, 541, 548; 220/253, 256, 257, 258, 266

[56] References Cited

U.S. PATENT DOCUMENTS

| | | | |
|---|---|---|---|
| 2,817,451 | 12/1957 | Giles et al. | 222/480 X |
| 3,058,630 | 10/1962 | Abt | 222/548 X |
| 3,463,364 | 8/1969 | Rehag | 222/548 X |
| 4,541,541 | 9/1985 | Hickman et al. | 220/253 |
| 4,611,725 | 9/1986 | Kacalieff | 222/153 X |

*Primary Examiner*—Kevin P. Shaver

*Attorney, Agent, or Firm*—Pearne, Gordon, McCoy & Granger

[57] ABSTRACT

A tamper-evident dispenser end closure including an imperforate hermetically sealed base and a rotor pivotally connected to the base by a snap-fit between a female pocket formed in the base and an annular male protrusion formed in the rotor. The protrusion contains an opening for visual detection of tampering with the pocket of the base. The base and rotor are retained in a close superposed relationship by the snap-fit pocket and protrusion. Frangible means are provided which tear or break when an attempt is made to separate the base from the rotor thereby evidencing tampering with the rotor. The base and rotor have webs provided with means defining respective dispensing apertures.

6 Claims, 2 Drawing Sheets

TAMPER-EVIDENT CLOSURE FOR DISPENSERS

BACKGROUND OF THE INVENTION

This invention relates generally to end closures for dispensers, cans, containers, and the like. More particularly, the invention relates to tamper-resistant closures having rotary tops.

PRIOR ART

Many different types of containers and closures have been developed to meet consumer needs for dispensing foods, condiments, chemicals, household cleansers, and similar products. One of the most popular closure designs from an aesthetic as well as convenience point of view is the rotary top closure having multiple openings commonly used for dispensing granulated foods and flavorings.

The rotary top design typically includes two major elements, namely, the rotor and the base. The base is attached to the end of a container, typically a hollow cylinder, by a suitable adhesive, friction fit, or like means. The base includes a web portion having one or more openings or windows therein through which the contents may be dispensed. Typically, to preserve freshness and to provide an indication of product integrity to the consumer, the dispensing opening is initially covered by a removable portion or tab of the web. The consumer can then push out the tab portion, thereby opening the container.

The rotor also includes a web portion having one or more openings therein which are alignable with, the base openings when the rotor is manually rotated by light finger pressure. The rotor may be pivotally attached to the base by a hub or stem which extends through a central opening in the base and forms a snap fit or friction fit between the base web and the hub.

While a frangible tab provides some indication that the package has not been opened in the normal manner, there is no readily perceivable indication to the consumer that the base and rotor have been pulled apart or separated in an effort to tamper with the contents. When the rotor is pulled off the base, the contents may be adulterated through the hub opening in the base web and the rotor reinstalled with no indication that the container has been tampered with.

U.S. Pat. No. 4,541,541, the disclosure of which is hereby incorporated by reference herein, discloses a tamper-evident end closure that corrects this deficiency. As taught there, by providing frangible areas on the base, rotor or hub, it is possible to have a portion of the end closure break or tear as a result of attempts to remove the rotor. This then provides ready indication of tampering and possible adulteration.

A blind pocket in the base may be used to hold a protrusion on the rotor in a rotatable snap-fit connection. This allows the base to be hermetically sealed. However, the clever miscreant may be able to remove the rotor without damage, pierce the bottom of the pocket, adulterate the contents of the container and replace the rotor. The replaced rotor then covers the area of surreptitious entry.

SUMMARY OF THE INVENTION

The present invention provides a new and improved end closure for containers and like articles which is tamper-resistant, hermetically sealed and convenient to use.

According to one aspect of the invention, an end closure is disclosed which immediately provides visual or structural indicia to the end user or consumer that the closure has been tampered with and the contents have possibly been adulterated.

According to another aspect of the invention, a hermetically sealed closure for maximum freshness and security is provided along with snap-fit ease of assembly.

These and other aspects and advantages of the invention will be more fully understood from the following description in view of the accompanying drawings.

DESCRIPTION OF THE PREFERRED EMBODIMENTS

Figure 1:
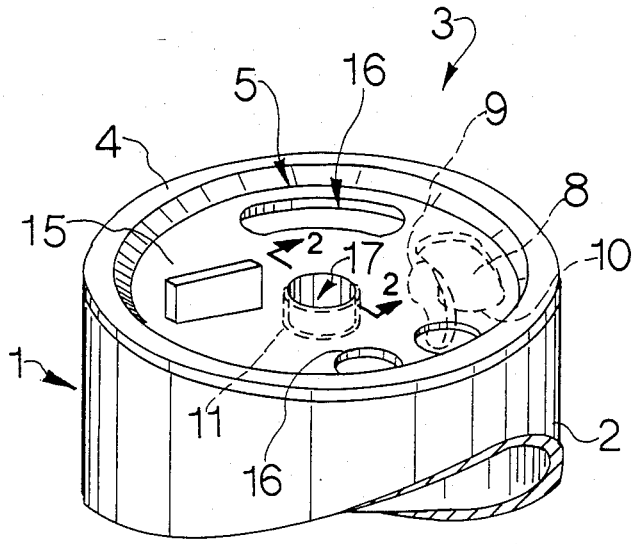
FIG. 1 is a perspective view of a container having a rotatable end closure according to the present invention.

The upper portion of a container such as for food products, condiments and similar granular products is generally indicated by the numeral 1 in FIG. 1. Such container is generally cylindrical in shape, having a wall portion 2, a bottom cap (not shown), and a rotatable top end closure, generally indicated by the numeral 3, used for dispensing the contents of container 1. Typically, the disclosed end closures are made of injection-molded plastic parts with a suitable thermoplastic material such as styrene or polyethylene.

Closure 3 includes a base 4 and a rotor 5 pivotally attached to an outer side of the base. Base 4 is provided with an annular skirt 6 which engages the inner surface of wall portion 2 at an outlet end of container 1. The skirt 6 is friction-fitted or otherwise secured (such as with adhesive) in a substantially hermetically sealed manner with the inner surface to the wall 2. Thus, base 4 is held in hermetically sealed engagement with container 1 to prevent leakage, spoilage or contamination of the contents.

Referring to FIGS. 1 through 4, base 4 includes a thin web membrane 7 having a generally uniform thickness. Web 7 extends substantially across the dispensing end of wall 2. Web 7 typically is provided with one or more initially hermetically sealed dispensing means 8 which define apertures through which the contents can be dispensed.

Dispensing means 8 are formed in web 7 by providing one or more push-out tabs each defined by a perimeter 10 having a substantially reduced web or wall thickness. Each tab 9 is easily breakable by a manual force exerted thereon in a direction toward the interior of the container 1, thereby forming an aperture in web 7 (as shown in FIG. 1). In this manner the dispensing means 8 are initially hermetically sealed prior to pushing out tabs 9. The sizes and shapes of the apertures are a matter of design choice to one skilled in the art, depending on the item to be dispensed and particular dispensing mode desired, as by shaking, pouring, spooning or the like.

Web 7 is provided with a female pocket 11 of a substantially cylindrical shape extending generally toward the bottom of container 1. The pocket 11 is integrally formed with the web 7 and may be conveniently located centrally of web 7. Pocket 11 includes a side wall 12 substantially perpendicular to the base 4. The bottom 13 of pocket 11, being an integral end wall, is hermetically sealed, thus preventing ready adulteration and preserving freshness. Bead 14 is radially formed in the side wall 12.

Figure 2:
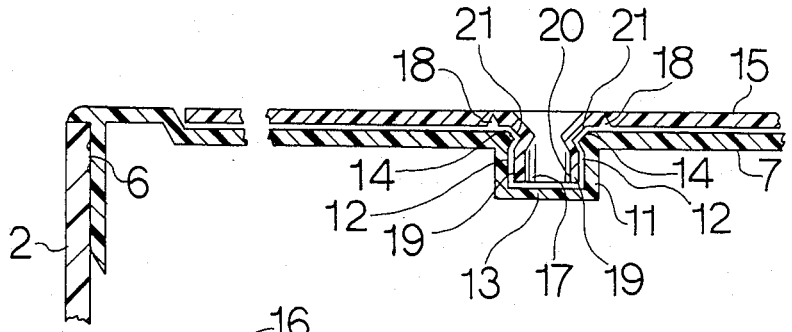
FIG. 2 is a cross-sectional view taken substantially along line 2—2 of FIG. 1.
Figure 3:
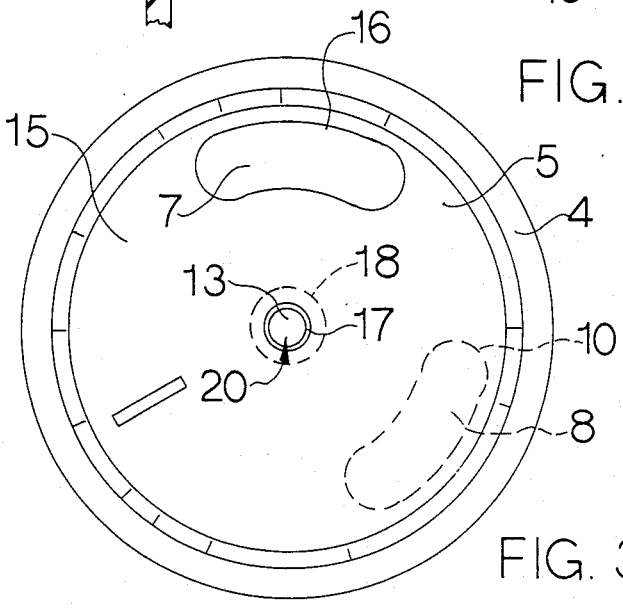
FIG. 3 is a top view of the end closure shown in FIG. 1 showing the visibility of the central portion of the base.

Rotor 5 is preferably a disc-like member having a web portion 15 provided with one or more openings 16 therein which are alignable with tab 9 or the aperture 8 formed therefrom by pivotal movement of, rotor 5. As shown in FIGS. 2 and 3, rotor web 15 is provided with a substantially cylindrical male protrusion 17 extending generally toward the bottom of container 1 and a frangible area of reduced web thickness, preferably an annular V-groove 18 concentrically located about protrusion 17. The protrusion 17 is integrally formed with rotor web 15 and may be conveniently located coaxial with the center of the rotor. Protrusion 17 includes a side wall 19 substantially perpendicular to the rotor 5 and contains an opening 20 through which pocket bottom 13 may be inspected visually for evidence of tampering. A radial groove 21 is formed in the side wall 19 of and, as described hereinafter, acts in concert with female pocket bead 14 to pivotally connect rotor 5 to base 4.

As best shown in FIG. 2, protrusion 17 and groove 21 act with pocket 11 and bead 14 to form a pivotable snap-fit connection between base 4 and rotor 5. Protrusion 17 extends into pocket 21 with a slight radial clearance when rotor 5 and base 4 are in their assembled superposed position. In their assembled position, bead 14 and groove 21 engage, holding rotor 5 and base 4 in close superposition while allowing rotor 5 to pivot about the axis of protrusion 17. Thus protrusion 17 and pocket 11 provide both a means for rotor 5 to pivot with respect to base 4 about the axis of protrusion 17 and a means to retain the rotor and base in a close, superposed position. It is of course possible instead to have the bead on the protrusion and the groove in the pocket and to have a plurality of either combination of bead and groove pairs.

Rotation of rotor 5 about the longitudinal axis of protrusion 17 allows either the opening of dispensing means 8 by alignment of rotor openings 16 with the base apertures, or closing the base apertures with a portion of the rotor web 15, as is well known in the art.

Figure 4:
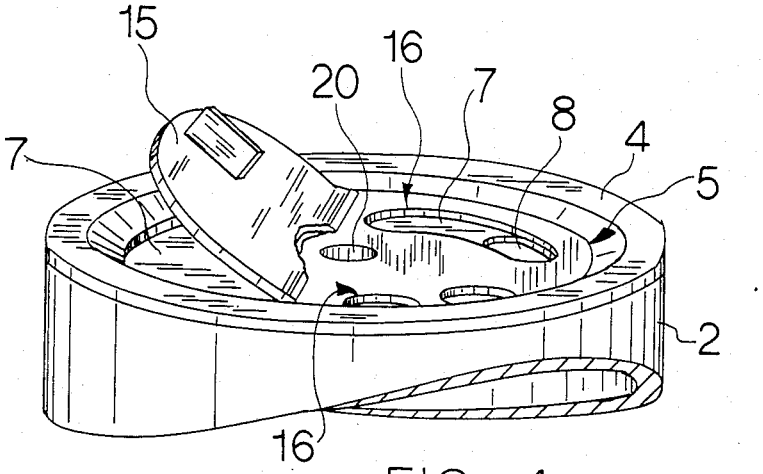
FIG. 4 is a perspective view of the end closure shown in FIG. 1 after a typical attempt to separate the rotor from the base.

The thickness of the frangible V-groove 18 is arranged such that it normally breaks or tears before the snap-fit connection between the rotor 5 and base 4 can be pulled apart. FIG. 4 shows the disclosed end closure after such an attempt to remove the rotor 5. It should be noted that the location and number of frangible areas on the rotor and base can be varied as required.

In most attempts to remove the rotor, the frangible area will break or tear providing indicia of the tampering. A careful miscreant may succeed in removing the rotor without damaging a frangible area. Without opening 20 in rotor 5, the pocket bottom 13 could be penetrated, the contents of container 1 adulterated and the rotor 5 replaced, covering all external evidence of tampering. Opening 20 ensures that there will be readily visible indication of tampering with the pocket bottom 13.

Figure 5:
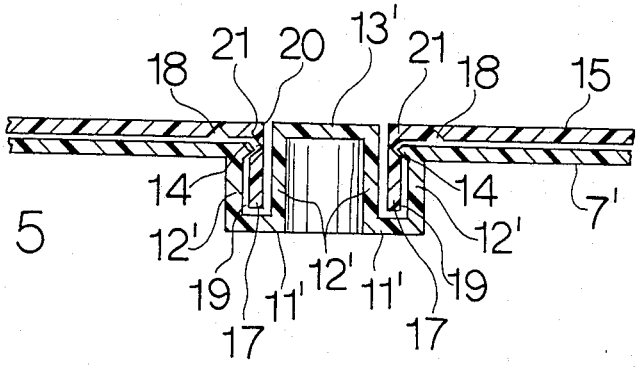
FIG. 5 is a cross-sectional view of another embodiment of the present invention.

Another embodiment of the present invention is shown in FIG. 5. In this case, rather than a cylindrical pocket, an annual pocket 11' is integrally formed in the base web 7'. Pocket 11' includes an outer side wall 12 and an inner side wall 12', both substantially perpendicular to base 4. The area 13' of the base web 7' within the circumference of the inner side wall 12' preferably extends through the, opening 20 in the rotor 5 flush with the top surface of the rotor. As in the first embodiment, at least one groove 20 and bead 14 combination may be used to provide a snap-fit pivotable connection retaining the rotor 5 and base 4 in a close superposed position.

This embodiment provides the additional advantage that no food particles or dirt may accumulate in the opening 20 in the rotor 5.

It will be appreciated from the foregoing description that a new and improved tamperproof end closure for a container has been disclosed which utilizes the convenience of a rotary disc-type dispenser while providing immediately perceivable indicia that the container has been tampered with.

It should be evident that this disclosure is by way of example and that various changes may be made by adding, modifying or eliminating details without departing from the fair scope of the teaching contained in this disclosure. The invention is therefore not limited to particular details of this disclosure expect to the extent that the following claims are necessarily so limited.

What is claimed is:

1. In a dispenser end closure having a hermetically sealed base, a rotor, means pivotally connecting the base to the rotor, the pivot means having an axis of rotation, the base and rotor having top surfaces, the base and rotor having webs with means defining respective dispensing apertures therein, the rotor dispensing aperture means being alignable with the base dispensing aperture means by pivotal movement of the rotor with respect to the base about the axis of the pivot means, said pivot means slidably retaining the base and rotor in a close superposed relationship, frangible means formed on at least one of said base, rotor and pivot means, the frangible means being adapted to tear when an attempt is made to separate the rotor and base, wherein said pivot means comprises a snap-fit pivotable connection between a female pocket formed in the base and an annular male protrusion formed in the rotor, the male protrusion having an opening through which a portion of the base radially inward of the pocket is visible.

2. An end closure according to claim 1, wherein the female pocket is of a generally cylindrical shape with a side wall substantially perpendicular to the top surface of the base.

3. An end closure according to claim 1, wherein said female pocket is of a generally annular, shape with inner and outer side walls substantially perpendicular to the top surface of the base.

4. An end closure according to claim 3, wherein the central portion of the base is raised above the top surface of the base such that said central portion extends through said opening in the rotor and is substantially flush with the top surface of the rotor.

5. An end closure according to claim 1, wherein at lease one of the male protrusion and female pocket has at least one radial groove and the other has a corresponding radial bead acting to frictionally retain sand rotor pivotally superposed on said base.

6. A tamper-resistant end closure for a container comprising a hermetically sealed base and a rotor pivotally connected to the base, the base having a web portion with a female pocket therein and means defining at least one dispensing aperture, the rotor having a web portion and a male protrusion, the male protrusion frictionally engaging with the female pocket and forming a snap-fit pivotable connection between said rotor and base, the pivotable connection having an axis of rotation, the pivotable connection retaining said base and rotor in a close, superposed, relationship, the rotor providing at least one opening in the rotor web substantially alignable with said means defining a dispensing aperture when the rotor is pivoted about the axis of the pivotable connection, frangible means on at least one of said base, rotor and pivotable connection means, the frangible means being adapted to break when an attempt is made to separate said base and rotor, thereby evidencing such attempt, and the male protrusion having an opening through which a portion of the base encircled by the pocket is visible, thereby allowing visual inspection of the integrity of said portion.

* * * * *